US007249996B1

(12) United States Patent
Volyar

(10) Patent No.: US 7,249,996 B1
(45) Date of Patent: Jul. 31, 2007

(54) VACUUM SANDER

(76) Inventor: Mykhaylo Volyar, 443 Kerrigan Blvd., Apt. 2, Newark, NJ (US) 07106

( * ) Notice: Subject to any disclaimer, the term of this patent is extended or adjusted under 35 U.S.C. 154(b) by 0 days.

(21) Appl. No.: 11/147,639

(22) Filed: Jun. 8, 2005

(51) Int. Cl.
*B24B 23/00* (2006.01)

(52) U.S. Cl. ..... 451/354; 451/456

(58) Field of Classification Search ..... 451/456, 451/354, 344
See application file for complete search history.

(56) References Cited

U.S. PATENT DOCUMENTS

| | | | | | |
|---|---|---|---|---|---|
| 689,484 | A | | 12/1901 | Cramer | |
| 2,238,757 | A | * | 4/1941 | Stevason | 15/98 |
| 2,394,858 | A | * | 2/1946 | Jeffreys | 451/354 |
| 2,670,577 | A | | 3/1954 | McDonough | |
| 2,753,669 | A | * | 7/1956 | Larson | 451/524 |
| 2,755,606 | A | | 7/1956 | Ronvold | |
| 3,268,935 | A | | 8/1966 | Ungeheuer | |
| 3,948,005 | A | | 4/1976 | Whitsett | |
| 4,204,292 | A | | 5/1980 | Lester | |
| 4,381,911 | A | | 5/1983 | Bell | |
| 4,546,574 | A | * | 10/1985 | Blossick et al. | 451/354 |
| 4,663,796 | A | | 5/1987 | Helling | |
| 4,829,719 | A | * | 5/1989 | Braselton | 451/354 |
| 4,937,984 | A | * | 7/1990 | Taranto | 451/524 |
| 4,964,243 | A | | 10/1990 | Reiter | |
| 5,193,313 | A | | 3/1993 | Sanchez | |
| 5,239,783 | A | * | 8/1993 | Matechuk | 451/354 |
| 5,540,616 | A | | 7/1996 | Thayer | |
| 5,624,305 | A | | 4/1997 | Brown | |
| 5,679,172 | A | * | 10/1997 | Pritt | 134/6 |
| 6,468,141 | B1 | | 10/2002 | Conboy | |
| 6,860,799 | B2 | * | 3/2005 | Loveless | 451/354 |

OTHER PUBLICATIONS

Sand & Klein Drywall Sanding System—owner's manual. Published by Sand & Klein, a division of Magna Industries, Inc. 2201 West 110th Street, Cleveland, OH 44102, 4 pages, undated.

* cited by examiner

*Primary Examiner*—Eileen P. Morgan
(74) *Attorney, Agent, or Firm*—Fox Rothschild, LLP; Vyacheslav Vasilyev; Michael Lewis

(57) ABSTRACT

A vacuum-assisted pole sander includes a sanding means attached at the end of the main pole, which in turn is supported in its middle section by a support pole. Both the support pole and the main pole are hollow and adjustable in length. The vacuum is transmitted from the sanding means of the device through the main pole to the vacuum connector in the supporting pole such that a vacuum can be attached on to ensure dust removal during operation. The combination of the support pole and the main pole is designed in such a way that the entire device is supported on the floor of the building under construction while allowing the operator to move it easily back and forth to achieve sanding of the ceiling. The support pole has a non-slip cap on its lower end and an angle connector on the other end. The angle connector is rotatably attached to the main pole such that it ensures the ability to swivel and at the same time provides a fluid communication between the inside portions of both the main pole and the support pole. The support pole is equipped with a vacuum attached for connecting to the suction means. The lower end of the main pole is equipped with vacuum strength adjustment means.

8 Claims, 4 Drawing Sheets

VACUUM SANDER

BACKGROUND OF THE INVENTION

The present invention relates generally to abrading or grinding devices. More particularly, the device of the invention relates to a ceiling vacuum-assisted grinding apparatus for use in surfacing of drywall and concrete ceilings.

Drywall and concrete have now become very popular materials used in the construction of buildings, mainly because of their strength and durability and because molding and casting technology has advanced greatly in recent years. However, in most cases after a concrete structure, such as a ceiling has been cast and the mold removed therefrom, the surface of the concrete ceiling is rough due to inconsistencies in the surface of the molds and indentations formed by the seams between adjacent molds. Thus, it is necessary to dress or smooth poured concrete ceilings by grinding the exposed surfaces of the ceiling. The same is generally true about the drywall ceilings although they require substantially less grinding to smooth the surface.

Although there have been ceiling grinding machines known in the prior art, these machines have been unsatisfactory in various manners. First, typically these grinding machines utilize abrading discs, cups or belts which wear out quickly, necessitating expensive and time consuming replacement, and do not provide a very strong abrading force to the concrete. Additionally, these ceiling grinding machines typically drive the abrading device by means of the flexible cable coupled to an electrical motor. However, this flexible cable is subject to intense frictional forces and therefore wears out quickly. Moreover, the use of single-phase electrical motors to run such abrading devices restricts the device to one rotational speed, thereby reducing the versatility of the device.

Another problem with prior art machines is their poor maneuverability. In most buildings under construction, both plumbing stubs and electrical conduit stubs protrude from the floor approximately 8 to 18 inches above the floor's surface and the prior art grinders have transverse axles and low horizontal framing which are well below the average height of the plumbing and electrical conduit stubs. This obviously causes interference and makes it difficult to maneuver the machine while trying to grind the ceiling above the floor.

A further problem is controlling the apparatus during the grinding operation. In the prior art devices, the grinding mechanism must be manually manipulated against the ceiling by the operator, while the operator moves the entire apparatus over the area to be grinded. This distracts the operator from safely traversing the floor upon which the apparatus is guided and also forces the operator to stand quiet close to the grinding assembly, increasing the chance of injury to the operator from flying concrete chips.

Examples of grinding machines of the prior art can be found in the U.S. Pat. Nos. 2,670,577; 2,755,606; 3,268,935; 3,948,005, and 4,381,911, all of which are incorporated herein by reference in their entirety.

Pole-mounted sanders have also been described in the prior art for the purpose of reaching the ceiling in a manner more convenient then with a hand-held sander. U.S. Pat. No. 4,663,796 describes an exemplary standard pole-mounted sander.

For many years carpenters, sheet-rockers, auto body sanders, tapers, etc. have attempted to cope with the problem of disposing conveniently of the remains of a sanding operation. Of course, a sanding operation typically ends with a large volume of sanding remains in the work area, both on the work surface and in the air. One of the common methods of disposing of the sanding remains related to a separate, after-operation vacuuming process for the work surface and the floor around the work surface. For this purpose, a large variety of "industrial-strength" vacuum system have been designed and developed. After all, the vacuum system had to cope with more then the usual dust and the like found in the home environment. Most importantly, such "industrial-strength" vacuum system did a fine job on the work surface and other proximate surfaces, but did nothing for the sanding remains spread throughout the air in the work place. Commonly, this subjected the person doing the sanding to lung and other health hazards, both during the sanding operation and thereafter.

Dust evacuation has been finally accomplished by various powered or manual sanders equipped with vacuum and suction means. More recently, inventors such as Shaw, U.S. Pat. No. 4,759,155 (incorporated herein in its entirety by reference) have developed methods and apparatus, which involve a plurality of holes in a sanding plate underlying the sand paper, which was designed with a porous material. In this way, the sanding remains are vacuumed during the sanding operation into a vacuum plenum, and this prevents, for the most parts, the dispersing of sanding remains into the air of the work place. However, the pattern of openings to the plenum and vacuum system in the underlying plate prove less efficient than it could be in gathering all of the sanding remains as the sanding operation proceeds. Also, the plenum tends to clog up.

In the U.S. Pat. No. 4,765,099 by Yanner there is disclosed a sanding and dust collecting apparatus. A housing assembly is attachable to and supported by a pneumatic sander. An impeller blade creates a vortex-like suction and thereby propels the particulate matter generated by the sander towards a collection bag.

Next is U.S. Pat. No. 4,937,984 issued to Thomas F. Taranto. This patent discloses a vacuum sander wherein a housing that forms a vacuum manifold communicating with an abrasive sheet at one end, the sheet being supported by an air permeable foam pad. Both a hand-held and a handle-held embodiment are described and it is explained that the source of the vacuum could be a standard household vacuum cleaner or the like.

U.S. Pat. No. 4,680,895 by Roestenberg discloses a block sander vacuum wherein a plurality of ports are disposed proximate a removably attached abrasive surface. These ports are connected to a coupling means for connection with a conventional vacuum cleaner. Additionally, on opposite sides of the body of the device are disposed depending skirts to aid in the collection and directing of the particulate matter generated by the sanding process.

Next in this discussion is U.S. Pat. No. 4,779,385 by Reiter. A gypsum board sanding apparatus is described wherein a paddle adapted to support a sheet of sandpaper includes a plurality of apertures both through and about it to allow for the passage of air and dust particles into a plenum that is connected to a conventional vacuum cleaner.

U.S. Pat. No. 4,964,243 (incorporated herein by reference in its entirety) also by Reiter discloses a vacuum pole sander. A sanding head includes a number of pedestals for supporting the abrasive material. The head member is configured to be attached to a universal joint and, to a pole for sanding hard to reach areas.

U.S. Pat. Nos. 5,193,313; 5,540,616; 5,624,305; and 6,468,141 (incorporated herein by reference in their entirety) describe various other useful variations of vacuum-assisted sanders mounted on a pole and having a universal swiveling joint between the sanding pad and the pole. U.S. Pat. No. 689,464, shows a power brush supported by a central pole.

Finally, U.S. Pat. No. 4,204,292 shows a portable powered scrubbing tool with vacuum assist and supported by two supporting poles: the main pole and the auxiliary pole extending from the mid portion of the main pole. It is adapted to be held by the operator using both hands.

Despite the above described advances in the sanding device, the need still exists for a low weight vacuum sander allowing sanding of a ceiling with minimal effort, while providing for excellent maneuverability and for effective removal of the dust and sand particles.

SUMMARY OF THE INVENTION

Accordingly, it is an object of the present invention to overcome these and other drawbacks of the prior art by providing a novel convenient to use vacuum sander requiring only a minimal physical effort of the operator, but adapted to achieve high quality sanding of difficult to reach surface such as ceiling or high walls.

It is another object of the present invention to provide a vacuum sander eliminating the need to use ladders and other equipment designed to raise the operator closer to the ceiling surface.

It is a further object of the present invention to provide a novel vacuum sander capable of removing maximum amount of dust and equipped with vacuum adjustment means.

The device of the invention is based on a vacuum-assisted pole sander. It is equipped with a support pole extending from the middle portion of the main pole. Both the support pole and the main pole are hollow and adjustable in length. The sanding means of the device is adapted to be in fluid communication through the main pole to the vacuum connector in the supporting pole such that a vacuum can be attached to the device of the invention to ensure dust removal during operation.

The main design feature of the invention is the combination of the support pole and the main pole. It is designed in such a way that the entire device is supported on the floor of the building under construction while allowing the operator to move it easily back and forth to achieve sanding of the ceiling. The support pole has a non-slip cap on its lower end and an angle connector on the other end. The angle connector is rotatably attached to the main pole such that it ensures the ability to swivel and at the same time a fluid communicator between the inside portions of both the main pole and the support pole. The support pole is equipped with a vacuum attachment for connecting to the suction means. The lower end of the main pole is equipped with vacuum strength adjustment means.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1:
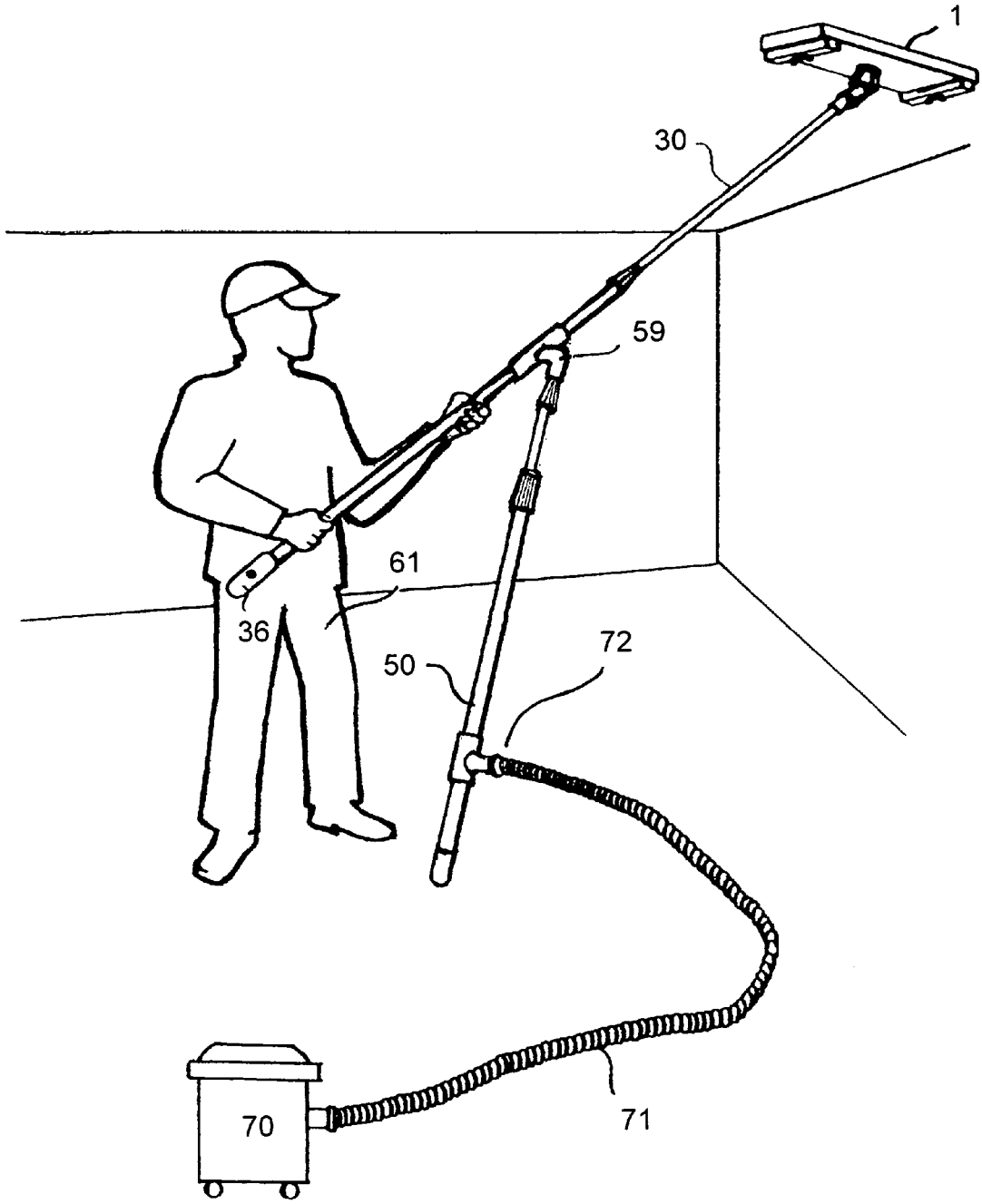
FIG. 1 is a general view of the vacuum sander of the present invention during its use.
Figure 2:
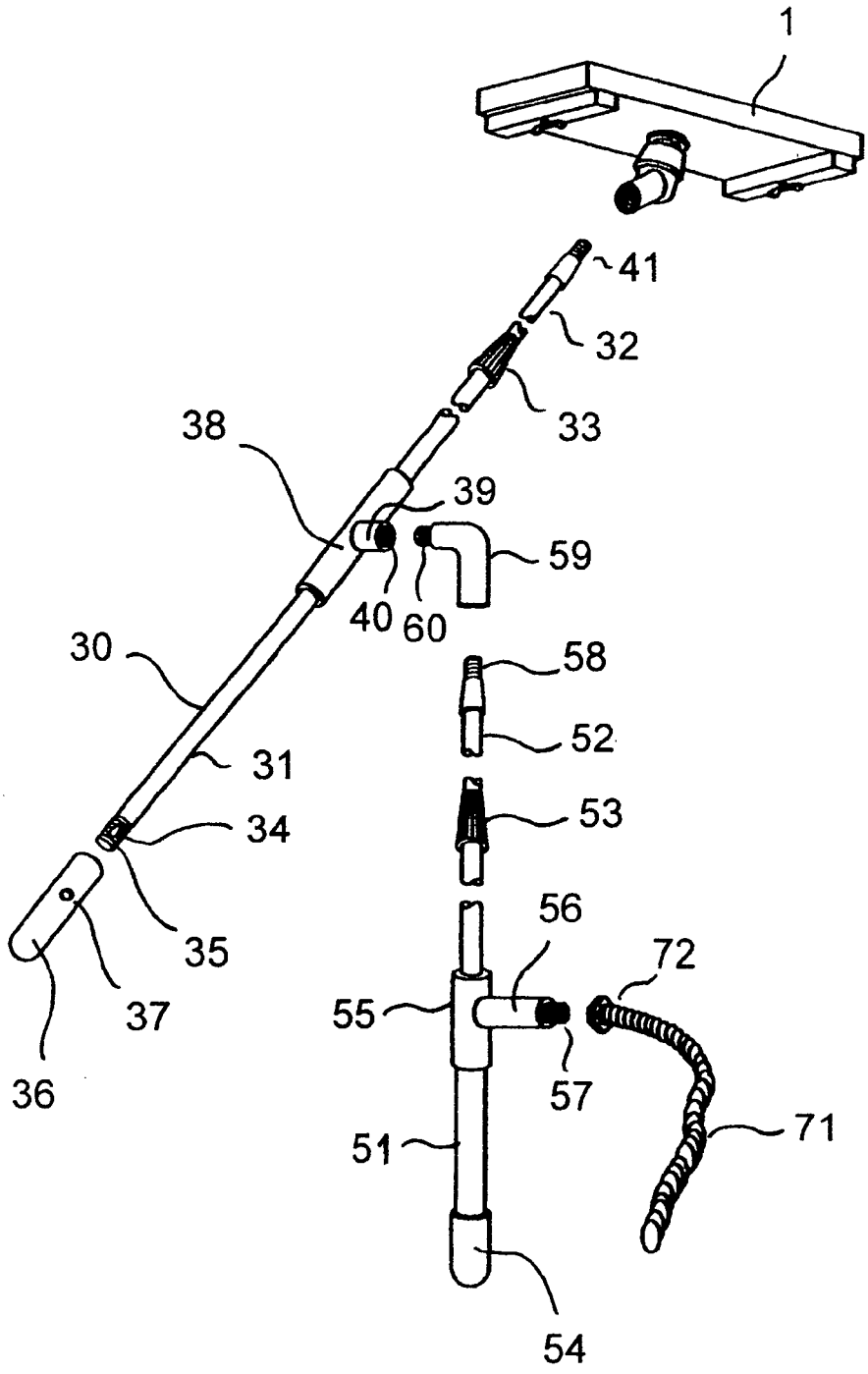
FIG. 2 is an exploded view of the vacuum sander of the invention.

FIG. 1 and FIG. 2 show the general and exploded views of the sander of the present invention. The device consists of the following key elements: the main pole 30 is extending from the operator 61 to support the sanding means 1 at its distal end such that it can swivel about it. Support pole 50 (See FIG. 1) is based on the floor of the building and is rotatably attached to the middle section of the main pole 1 through an angle connector 59. Vacuum attachment 72 allows connecting the vacuum 70 through the vacuum hose 71 to the device of the invention.

Figure 3A:
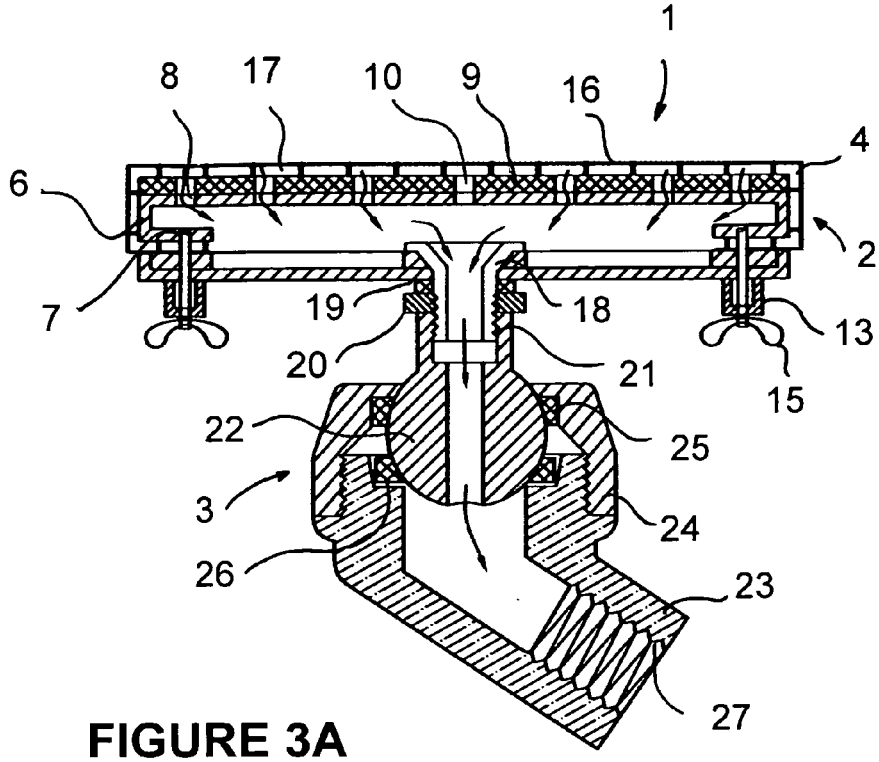
FIG. 3A is a cross-sectional view of the sanding means of the invention.
Figure 3B:
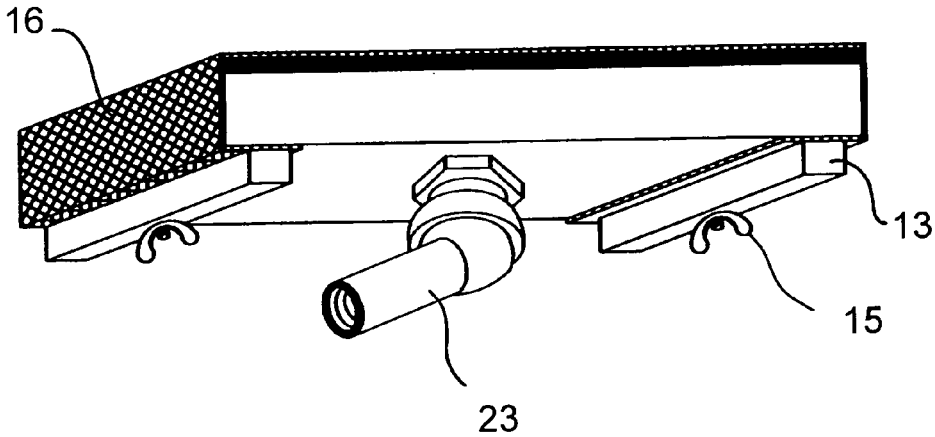
FIG. 3B is an elevation view of the sanding means of the invention as shown in cross-section on FIG. 3A.
Figure 4:
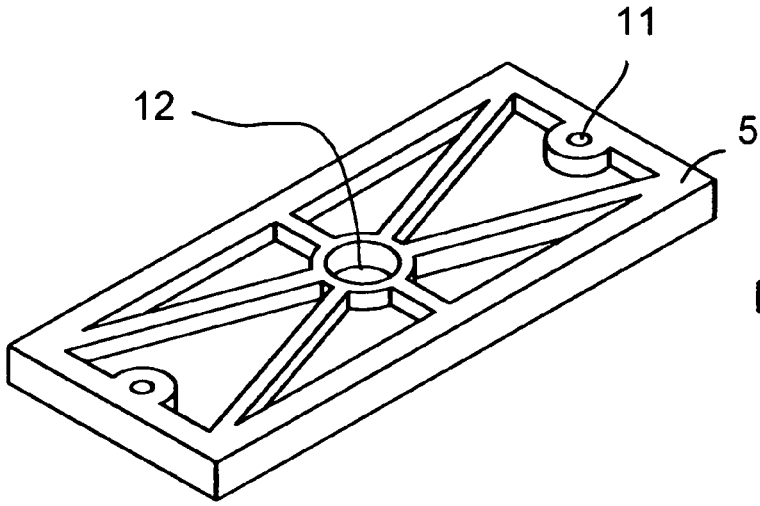
FIG. 4 is a general view of the cover of the sanding means.
Figure 5:
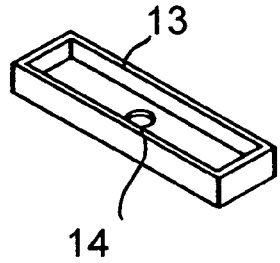
FIG. 5 is a general view of the clamp of the sanding means cover.
Figure 6:
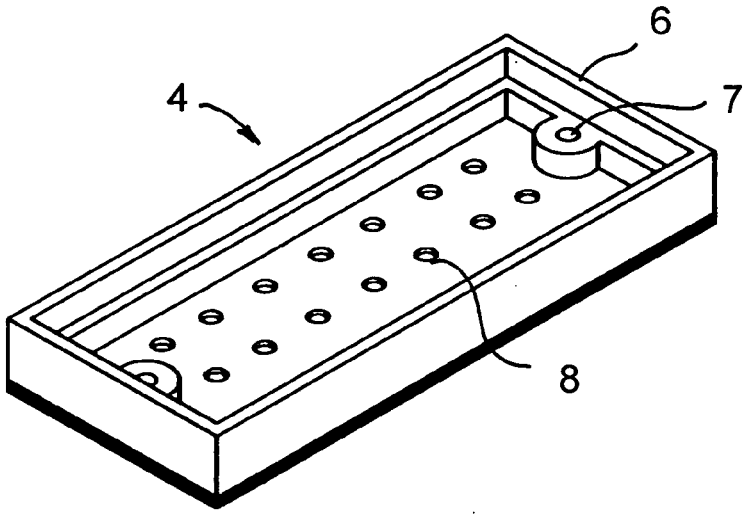
FIG. 6 is the elevation view of the U-shaped housing of the sanding means, as seen when flipped over.

Vacuum-assisted sanding means 1 can be designed to be similar to any known sanding means described in the above referenced patents of the prior art as long as it is equipped with vacuum-assisted dust removal means. In the most preferred embodiment of the invention, the sanding means 1(see FIG. 3) comprises a holder 2 attached to a transitional member 3. Holder 2 consists of a U-shaped housing 4 (shown best on FIG. 6) and a cover 5 (shown on FIG. 4) attached thereto by two bolts 15. The housing 4 is equipped with two attachment plates 6 located on its sides and spaced away from its top operating surface. Both plates 6 contain each a mounting threaded hole 7. The top operating surface of the housing 4 contains a plurality of suction openings 8. Preferably, an elastic gasket 9 is placed over the top surface of the housing 4 and having openings 10 located over the aligned with openings 8 of the housing 4. The cover 5 (see FIG. 4) has two symmetrical side holes 11 and large central opening 12. It is also equipped with two clamping strips 13, each having an opening 14 (see FIG. 5) and a treaded bolt 15 adapted for tightening by hand such as with a wing-nut top. Sanding member 16 is located on top of the elastic gasket 9. It envelopes the housing 4 and is retained thereabout by clamping it underneath the cover 5 with the help of the clamping strips 13 and the bolts 15.

Those skilled in the art would readily appreciate that other types of sanding means can be used for the purpose of this invention as well. One common type is the sanding block with sanding member such as a sanding paper attached thereto and a vacuum evacuation means having a plurality of openings about the periphery of such sanding block. Such other sanding means are all contemplated to be included in the scope of this invention although they are not shown or described here in more detail.

Transitional member 3 extends through the large central opening 12 of the cover 5 by means of a threaded hub 18, which is held inside the cover 5 by a nut 20 and washer 19. The ball member 22 is threaded onto the hub 18 via thread 21. The ball member is also attached to the swivel joint hub 23 via a treaded nut 24. Elastic seals 25 and 26 help to seal both sides of the attachment between the ball member 22 and the hub 23. The hub 23 is also equipped with the internal thread 27. Such arrangement of the hollow parts described above allows the sanding member 1 to rotate in any horizontal direction and partially rock for about 35 degrees in a vertical direction about the ball member 22 while providing an internal fluid path to aspirate dust particles from the sanding surface thereof.

The main pole 30 (see FIG. 2) consists of a hollow main primary pole 31 and a hollow main extension pole 32 located inside thereof and terminated with a threaded connector 41. Note that instead of making the poles hollow, outside tubing defining vacuum transmission means may be used to carry vacuum aspiration to the sanding means 1 (not shown). The distal end of the primary pole 31 (aimed at the sanding means 1) is equipped with a twisting clamp 33 designed for tightening around the extension pole 32 when needed to keep it in place relative to the primary pole 31. The proximal end of the primary pole is equipped with a thread 34 having a vacuum strength adjustment means consisting of a vacuum adjustment opening 35, which may preferably have an oval shape. The handle 37 having its own opening 37 is threaded onto the proximal end of the primary pole 31. The middle section of the main pole 30 contains a T-shaped connector 38 having a hollow side branch 39 with an internal thread 39 or another alternative means of airtight quick connection allowing rotation. Preferably, the location of the T-shaped connector is chosen in such a way that the main pole is supported about its center of gravity.

Support pole 50 consists of a hollow primary support pole 51 and a hollow extension support pole 52 located inside thereof as shown in detail on FIG. 2. The primary support pole 51 is equipped with a twisting clamp adapted to tighten the extension support pole 52 in place when appropriate length adjustment is done. The lower portion of the primary support pole 51 is closed by non-slip cap 54. Preferably, the cap is a cover made from a non-slip material such as rubber or alike such that inadvertent slipping of the device is prevented when in use.

A T-shaped connector 55 is located in the middle portion of the primary support pole 51. It contains a side branch 56 with a threaded end 57 serving as vacuum attachment means and sized to accept standard industrial vacuum hose 71 via an incorporated attachment nut 72.

The main pole 30 is supported by the support pole 50 by attaching a side branch 39 of the T-shaped connector 38 to the threaded end 60 of the angle connector 59, which in turn is attached to the extension support pole 52 forming a distal end thereof. Importantly, the attachment of the branch 39 to the angle connector 59 while airtight allows rotation of the main pole 30 about the support pole 50.

Instead of transmitting vacuum inside the hollow members of the device defining vacuum transmission means, one skilled in the art may easily appreciate that outside tubing may be used as such vacuum transmission means (although with less convenience) to attach the vacuum 70 to the sanding means 1.

In use, the operator 61 positions the device of the invention on the floor underneath the section of the ceiling requiring sanding and attaches the vacuum 70 to the connector 55. The length of both the main and the support poles is then adjusted such that the sanding means 1 can reach the ceiling while the main pole is suspended in a tilted position and supported by the operator 61 by holding the handle 36. The vacuum 70 is then turned on and the handle 36 is turned until the appropriate strength of vacuum is achieved by positioning the opening 37 over the appropriate portion of the opening 35. The choice of the vacuum strength is determined by the friction force between the ceiling and the sanding means 1 as well as of the type of work needed to be conducted and materials involved.

The operator then moves the sanding means 1 along the ceiling using the main and supporting poles as levers. Such use allows the operator to both move the device back and forth and at the same time apply the necessary (sometimes significant) level of force onto the sanding means 1, all without substantial physical force from his part. As the sanding means 1 is moved about the ceiling, the supporting pole 50 is bending over and the main pole 30 is tilting about the angle connector 59. The operator can also optionally conduct turning movements of the device without the swinging of the main pole about the support pole. Note that the sanding means 1 is maintained in horizontal orientation at all times by swinging about the ball member 22 so that a good contact with the surface of the ceiling is always ensured.

Dust generated during the use of the device is continuously removed by the vacuum 70 through all the internal passages described above, starting from the openings 17 in the sanding means and ending with the hollow inside space of all the poles.

The device of the invention can also be used advantageously for sanding of vertical surfaces such as walls. In that case, the supporting pole 50 is disconnected and the vacuum hose 71 is attached directly to the main pole 30 through the attachment 38 (adapter may be used for that purpose)

The device can also be used for painting the walls and the ceilings of the building. The vacuum is disconnected in that case, and the housing 4 is covered by a painting pad or a painting roll (appropriate attachments are contemplated but not shown on the drawings).

The present invention has a wide range of uses in the construction industry. Because of the adjustable length of both the main and the support poles, the device can be used to perform work on the walls and ceilings of buildings having a broad range of floor heights, both inside and outside the building. Extreme maneuverability of the device helps in renovation projects when it can be used without the need to move all furniture.

Although the invention herein has been described with respect to particular embodiments, it is understood that these embodiments are merely illustrative of the principles and applications of the present invention. For example, various threaded connections can be replaced with snap-on connectors and so on. It is therefore to be understood that numerous modifications may be made to the illustrative embodiments and that other arrangements may be deviced without departing from the spirit and scope of the present invention as defined by the appended claims

What is claimed is:

1. A vacuum sander comprising:

a main pole comprising a main primary pole and a main extension pole extending therefrom, said main extension pole having a distal end, a vacuum-assisted sanding means rotatably attached to the distal end of the main extension pole, a support pole extending from a base adapted to enable rocking of the support pole and including a primary support pole and an extension support pole extending from said primary support pole, said extension support pole is equipped with an angle connector rotatably attached to said main pole, and a vacuum transmission means adapted to connect said vacuum assisted sanding means to a vacuum, whereby both said main and said support poles have independently adjustable lengths such that said vacuum sander is adapted for moving said sanding means back and forth on the distal end of said main extension pole while said main pole is supported by said support pole, while said support pole in turn is rocking about said base.

2. The vacuum sander as in claim 1, wherein said main pole and said support pole are made hollow to define said vacuum transmission means.

3. The vacuum sander as in claim 2, wherein said primary main pole defining a proximal end equipped with a vacuum strength adjustment means, said vacuum strength adjustment means comprising a handle with an threaded opening attached to said proximal end of said primary main pole, said proximal end containing a vacuum adjustment opening, whereby rotation of said handle aligns said handle opening with said vacuum adjustment opening for proper selection of desired vacuum strength.

4. The vacuum sander as in claim 1, wherein said base adapted to enable rocking of said support pole is made from a non-slip material.

5. The vacuum sander as in claim 1, wherein said vacuum-assisted sanding means comprises a hollow U-shaped housing and a sanding member attached to said housing by a cover, said housing, cover, and sanding member all containing openings aligned to each other to allow removal of dust generated during sanding by said vacuum.

6. The vacuum sander as in claim 1, wherein said main primary pole and said support primary pole are each equipped with a twisting clamp to retain respectively said main extension pole and said support extension pole in their desired respective positions.

7. The vacuum sander as in claim 1, wherein said main pole defining a middle section, said angle connector rotatably attached to said middle section of said main pole in an airtight manner.

8. The vacuum sander as in claim 7, wherein said angle connector is attached to said middle section of said main pole to support thereof about its center of gravity.

* * * * *